United States Patent [19]

Harada et al.

[11] 4,138,813

[45] Feb. 13, 1979

[54] GUIDE BAR FOR CHAIN SAW

[75] Inventors: Tatsuzo Harada, Chofu; Torao Kobayashi, Tokyo, both of Japan

[73] Assignee: Kioritz Corporation, Tokyo, Japan

[21] Appl. No.: 879,978

[22] Filed: Feb. 22, 1978

[30] Foreign Application Priority Data

Apr. 1, 1977 [JP] Japan ..... 52-39327[U]

[51] Int. Cl.[2] ..... B27B 17/02

[52] U.S. Cl. ..... 30/387

[58] Field of Search ..... 30/387, 383, 384; 29/463; 83/820, 821, 824

[56] References Cited

U.S. PATENT DOCUMENTS

| | | | |
|---|---|---|---|
| 2,838,833 | 6/1958 | Richardson | 30/387 X |
| 2,962,061 | 11/1960 | Nielsen | 30/387 X |
| 3,949,475 | 4/1976 | Tokarz | 30/387 |

FOREIGN PATENT DOCUMENTS

| | | | |
|---|---|---|---|
| 2321316 | 11/1974 | Fed. Rep. of Germany | 30/387 |

*Primary Examiner*—Jimmy C. Peters

*Attorney, Agent, or Firm*—Karl W. Flocks

[57] ABSTRACT

A guide bar for a chain saw including a pair of plates of a small thickness each formed, on its surface, by means of a press, with a groove extending in its marginal portion substantially parallel to its edge. The pair of plates are positioned back to back at the bulging bottoms of the grooves and bonded together to provide, in a peripheral portion of the guide bar, a chain guide groove defined by the marginal portions of the two plates of a small thickness.

1 Claim, 4 Drawing Figures

GUIDE BAR FOR CHAIN SAW

BACKGROUND OF THE INVENTION

This invention relates to a guide bar for a chain saw.

Generally, a guide bar for a chain saw has been formed of a single plate or three plates bonded together into a laminate. Since a portable chain saw is operated by an operator who holds it by hand, it has been desired to reduce the weight of the body of a chain saw. When a guide bar is formed by working a single plate of a large thickness, it is time consuming and requires a lot of labor to effect machining of the thick plate. Moreover, the material cost and the working cost are high, so that the method of producing guide bars by working plates of a large thickness is not suitable for producing guide bars on a mass production basis. Also, in producing guide bars by bonding together three small thickness plates into a laminate, the method for working the three plates and bonding them is complicated and requires a large number of method steps to be followed. The method of producing guide bars by bonding three plates together into a laminate is more desirable than the method of producing guide bars each from a single plate of a large thickness. However, the guide bars in laminate form raise problems with regard to weight, working method and cost.

SUMMARY OF THE INVENTION

This invention has as its object the provision of a chain saw guide bar which is light in weight, low in cost and easy to handle.

The guide bar for a chain saw according to the present invention includes a pair of plates of a small thickness each formed on its surface, by means of a press, with a groove extending in its marginal portion substantially parallel to its edge. The pair of plates are positioned back to back at the bulging bottoms of the grooves and bonded together to provide, in a peripheral portion of the guide bar, a chain guide groove defined by the marginal portions of the two plates of a small thickness.

By working on plates of a small thickness, to form a groove on each of their surfaces (to provide ribbed surfaces), it is possible to increase the rigidity of the guide bar, and the grooves can be arranged in any position as desired to provide necessary strength to the guide bar. Thus the provision of a groove on the surface of each of a pair of plates of a small thickness makes it possible to increase the strength of the guide plate to a certain extent without increasing its weight.

A sandwiched plate is inserted and held between the pair of plates of a small thickness in a portion of each guide bar at which the guide bar is attached to a chain saw main body, with the result that the guide bar according to the invention can meet the requirements of complicated construction and function of the guide bar attaching portion as guide bars of the prior art have been able to do.

The guide bar attaching portion of each guide bar is formed with oil feed ports which communicate with the chain guide groove. Thus it is necessary to prevent oil leakage in this portion of the guide bar by working this portion with increased precision to provide an airtight seal to this portion. The guide bar according to the invention can serve this purpose.

The guide bar according to the invention enables the weight of its operating portion in the front half thereof to be reduced to meet the requirement of reducing its weight as a whole. Thus the guide bar of a long shape shows the tendency of its forward portion becoming relatively light in weight. This permits the guide bar to be handled with ease when combined with a chain saw, thereby enabling a sawing operation to be performed readily and with increased efficiency.

DESCRIPTION OF THE PREFERRED EMBODIMENT

The invention will now be described by referring to a preferred embodiment shown in the accompanying drawings.

Figure 1:
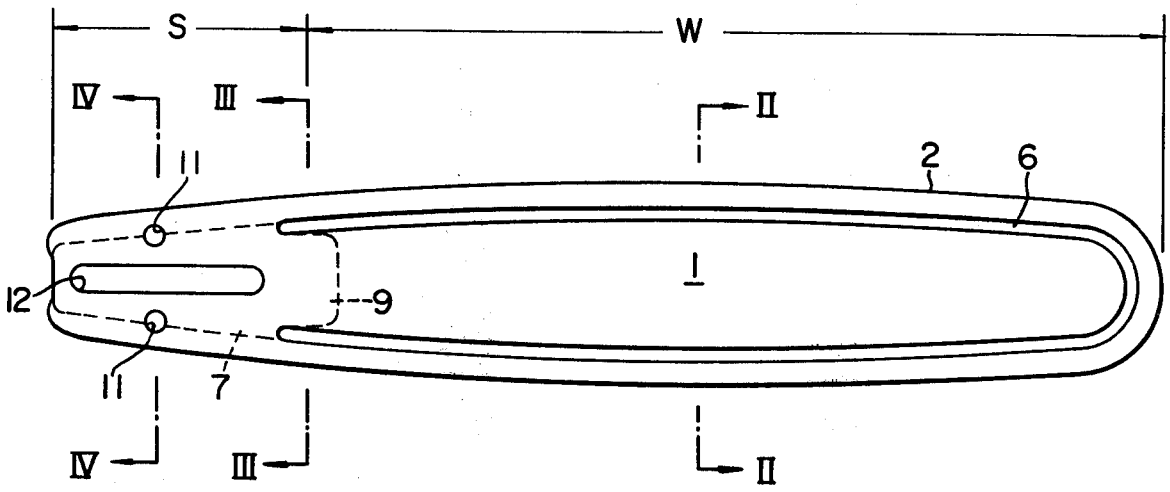
FIG. 1 is a side view of the guide bar comprising one embodiment of this invention.
Figure 4:
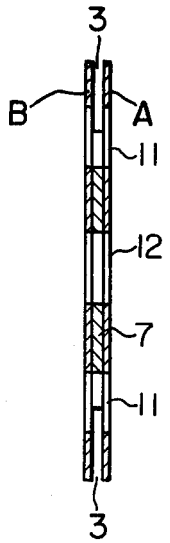
FIG. 4 is a sectional view taken along the line IV—IV in FIG. 1.
Figure 3:
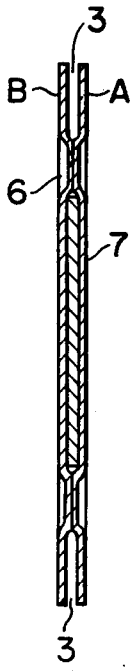
FIG. 3 is a sectional view taken along the line III—III in FIG. 1.
Figure 2:
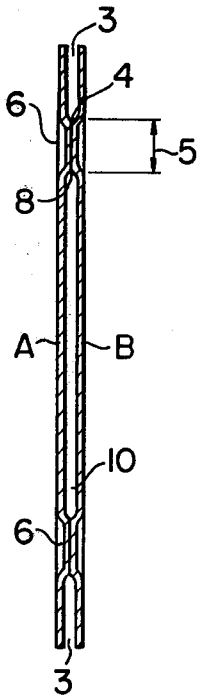
FIG. 2 is a sectional view taken along the line II—II in FIG. 1.

FIG. 1 is a side view of the guide bar which, although it is of the same shape as guide bars commercially available now, incorporates therein the features of the present invention. FIG. 2 is a sectional view taken along the line II—II in FIG. 1, FIG. 3 is a sectional view taken along the line III—III in FIG. 1 and FIG. 4 is a sectional view taken along the line IV—IV in FIG. 1. Guide bars similar in shape to the guide bar shown in the drawings are still being produced by machining a single plate of a large thickness as was done in the past. Since a single plate of a large thickness is of high quality as a material, it is high in cost and heavy in weight. Generally, a guide bar is about 20 to 25 percent in weight of a chain saw main body when the guide bar and the chain saw main body are combined with each other in a standard fashion. It is possible to reduce the weight of the chain saw main body still further, although the weight of the chain saw has already been reduced nearly to a maximum. As the chain saw main body becomes lighter in weight, the ratio of the weight of the guide bar to that of the chain saw main body increases, unless the weight of the guide bar itself is also reduced. Thus it is urgently desired to reduce the weight of the guide bar. The fact is that the larger the size of the chain saw, the higher is the absolute value of the weight of the guide bar, so that the guide bar itself is considerably heavy in weight.

Once in a while, there are reports in the literature which suggest that the weight of a guide bar itself be reduced by reducing its thickness in some portions thereof. However, there have ever been no attempts made to accomplish this object with any degree of success. In view of this situation, the present invention has been developed to provide a novel guide bar which can be put to practical use and to thereby contribute to the advance in the progress of industry.

A guide bar 1 for a chain saw is in the form of an elongated ellipse and formed with a chain guide groove 3 in its marginal portion 2. It has hitherto been usual practice to form the chain guide groove 3 by machining. In working a plate to provide the chain guide groove 3, a large number of method steps have to be followed. The guide bar 1 according to the invention includes two plates A and B of a small thickness which would be obtained if a guide bar of the prior art were divided into two plates along the groove 3. Each of the small thickness plates A and B is worked by means of a press to form on its surface a groove 6 of a suitable width 5 extending along a bottom line 4 of the groove 3. The groove 6 extends in a marginal portion of each plate A (B) substantially parallel to its edge in a working portion W of the guide bar 1. The two small thickness plates A and B are arranged back to back at the bulging bottoms of the grooves 6 which constitute abutting surfaces 8. Thus the width of the chain guide groove 3 is maintained at a predetermined level. The width of the groove 6 and its shape and arrangement may vary depending on the ability required of the guide bar 1 in accordance with its size. For example, if a single groove (not shown) is formed in the central portion of the guide bar on each surface thereof, it is possible to increase the rigidity of the guide bar.

The guide bar 1 includes an attaching portion S in which a sandwiched plate 7 having a thickness corresponding to the width of the chain guide groove 3 and the transverse dimension is reduced by an amount corresponding to the depth of the chain guide groove 3 is inserted in a gap between the plates A and B to be held therebetween and lapped at 9 to portions of the plates A and B adjacent the groove 6 in the working portion W, so that the attaching portion S will have required rigidity and strength. The small thickness plates A and B are then bonded together at the abutting surfaces 8 as by applying pressure after a foil or powder of a nonferrous metal (such as copper) are interposed between the abutting surfaces 8 or after the abutting surfaces 8 are plated with a nonferrous metal, heating the abutting surfaces 8 for causing the interposed metal to melt and spread, suddenly cooling the abutting surfaces 8, and causing the interposed metal to set, thereby providing the guide bar 1.

The reason why copper is preferred as a metal for brazing the abutting surfaces is because copper not only is readily available in the form of a foil or as a plating material but also has a high melting temperature. The latter feature enables the completed guide bar 1 to have a suitable temperature adaptability, in addition to permitting the plates A and B to be bonded together with high strength. It is to be understood that a suitable bonding agent for metals may be used for bonding together the plates A and B.

In the drawings, 11 designates oil feed openings for the chain guide groove 3, and 12 designates a slot for attaching the guide plate to a chain saw main body.

What is claimed is:

1. A guide bar for a chain saw comprising:

a pair of small thickness plates bonded together to provide the guide bar divided into a working portion and an attaching portion for attaching the guide bar to a chain saw main body;

a groove formed in said working portion by means of a press on an upper surface of each of said small thickness plates and extending in its marginal portion substantially parallel to its edge;

a chain guide groove located in a peripheral portion of the guide bar and defined by the marginal portions of the small thickness plates, said chain guide groove being formed by arranging the two small thickness plates back to back at bulging bottoms of the grooves serving as abutting surfaces and bonding them together at the abutting surfaces; and a sandwiched plate inserted and held between said small thickness plates in said attaching portion of the guide plate, said sandwiched plate having a thickness corresponding to the width of said chain guide groove.

* * * * *